US010153599B1

(12) United States Patent
Lin

(10) Patent No.: US 10,153,599 B1
(45) Date of Patent: Dec. 11, 2018

(54) POWER PLUG STRUCTURE FOR LIGHT EMITTING ELECTRIC POWER CORD

(71) Applicant: Chia-hua Lin, New Taipei (TW)

(72) Inventor: Chia-hua Lin, New Taipei (TW)

( * ) Notice: Subject to any disclaimer, the term of this patent is extended or adjusted under 35 U.S.C. 154(b) by 0 days.

(21) Appl. No.: 15/904,815

(22) Filed: Feb. 26, 2018

(51) Int. Cl.

| | |
|---|---|
| ***H01R 13/717*** | (2006.01) |
| ***H01R 13/66*** | (2006.01) |
| ***H01R 24/28*** | (2011.01) |
| *H01R 25/00* | (2006.01) |
| *H01R 103/00* | (2006.01) |

(52) U.S. Cl.
CPC ..... *H01R 13/7175* (2013.01); *H01R 13/665* (2013.01); *H01R 13/7172* (2013.01); *H01R 24/28* (2013.01); *H01R 25/006* (2013.01); *H01R 2103/00* (2013.01)

(58) Field of Classification Search
CPC ..... H01R 13/7175; H01R 13/665; H01R 13/7172
USPC ..... 439/490
See application file for complete search history.

(56) References Cited

U.S. PATENT DOCUMENTS

| | | | | | |
|---|---|---|---|---|---|
| 3,856,376 | A * | 12/1974 | Poliak | H01R 13/502 | 439/465 |
| 5,567,175 | A * | 10/1996 | Warden | H01R 13/717 | 264/272.11 |
| 5,666,453 | A * | 9/1997 | Dannenmann | G02B 6/3895 | 385/100 |
| 6,532,328 | B1 * | 3/2003 | Kline | G02B 6/4482 | 385/101 |
| 6,969,273 | B2 * | 11/2005 | Chen | H01R 13/641 | 439/490 |
| 6,979,223 | B2 * | 12/2005 | Chen | H01R 13/641 | 439/490 |
| 7,029,137 | B2 * | 4/2006 | Lionetti | H01B 7/366 | 362/253 |
| 7,544,909 | B2 * | 6/2009 | Dhir | H01R 13/7175 | 200/51.11 |
| 7,677,916 | B2 * | 3/2010 | Chang | H01R 4/029 | 439/490 |
| 9,373,921 | B1 * | 6/2016 | Lin | H01R 25/003 | |
| 9,912,081 | B2 * | 3/2018 | Corona | H01R 4/2404 | |
| 9,948,020 | B1 * | 4/2018 | Lin | H01R 13/447 | |
| 2004/0042735 | A1 * | 3/2004 | Ma | H01R 13/6641 | 385/88 |

(Continued)

OTHER PUBLICATIONS

Chia-Hua Lin, "Light Emitting Power Line Plug Structure", filed on Sep. 18, 2017, USPTO, U.S. Appl. No. 15/707,147.

*Primary Examiner* — Tulsidas C Patel
*Assistant Examiner* — Peter G Leigh
(74) *Attorney, Agent, or Firm* — WPAT, PC

(57) ABSTRACT

A power plug structure for light emitting electric power cord is disclosed, wherein a plug body is internally combined with a circuit board comprising at least a circuit device and two conductive boards, in which the circuit device includes at least a light emitting diode (LED), and the LED respectively corresponds a light guiding line within a power line; accordingly, when the two conductive boards guide alternative current (AC) power to the LED, the circuit device can drive the LED to generate light such that the light guiding line can integrally illuminate because of the light conduction, and the entire electric power cord can glow outwards through the translucent cladding.

7 Claims, 8 Drawing Sheets

(56) References Cited

U.S. PATENT DOCUMENTS

| | | | | |
|---|---|---|---|---|
| 2004/0071410 | A1* | 4/2004 | Ma | H01R 13/6641 385/88 |
| 2004/0235338 | A1* | 11/2004 | Lee | H01R 24/28 439/490 |
| 2005/0124209 | A1* | 6/2005 | Currie | H01R 13/7172 439/490 |
| 2008/0293290 | A1* | 11/2008 | Ku | H01R 13/7175 439/490 |
| 2017/0033514 | A1* | 2/2017 | Wang | H01R 13/7175 |

* cited by examiner

POWER PLUG STRUCTURE FOR LIGHT EMITTING ELECTRIC POWER CORD

BACKGROUND OF THE INVENTION

1. Field of the Invention

The present invention generally relates to a power plug structure for light emitting electric power cord; in particular, it relates to a power plug structure for light emitting electric power cord capable of achieving the objective of fast assemblage, wherein a circuit board is installed within a plug body, and two conductive boards extend from the circuit board so as to directly connectedly joint to a live wire conductive slice and a neutral wire conductive slice, respectively, thereby saving working hours needed for pulling wires to the circuit device.

2. Description of Related Art

At present, household appliances draw electric power from the electric power sockets by using a plug, so the use of electricity has become a portion of everybody's family lives; additionally, in a generally known power outlet, there may be installed with a sort of light emitting device inside the plug accommodation body so as to provide light in the dark state, thus indicating the location of the power outlet to the user.

But, since the electric power cord and the power plug extending directly from the electronic device itself typically are unable to show whether the electric power has been conducted or not, it is quite desirable to install a sort of light emitting circuit inside the conventional electric power plug and to provide a light guiding line contained within the electric power cord so that the light guiding line can extend from the electric power cord to the electric power plug, such that, when the electric power plug is inserted into the power supply socket, the conductive connection of electricity from the power outlet can enable the light emitting components included in the light emitting circuit to illuminate, thereby allowing the light to travel into the light guiding line to transfer and glow; moreover, the electric power cord may be made of translucent materials so the light emitted from the light guiding line can penetrate the electric power cord thus allowing the user to see the illuminating power line, which may offer an optimal solution for the above-mentioned issues.

Additionally, the applicant of the present invention has filed the patent application Ser. No. 15/707,147 on Sep. 18, 2017.

SUMMARY OF THE INVENTION

The present invention discloses a power plug structure for light emitting electric power cord, comprising: a plug body, with one end thereof being connected to an electric power cord having a translucent cladding, wherein the inside of the electric power cord includes multiple power lines for transferring alternative current (AC) and at least a light guiding line, the front ends of such power lines and the light guiding line respectively extend into the plug body, while the other end of the plug body not installed with the electric power cord is configured in exposure with a set of conductive slices such that the power lines can be electrically connected to the tail ends of the neutral wire conductive slice and the live wire conductive slice respectively, thereby conducting electric power to the output ends of the power lines, and the plug body is also installed in combination with a seat body, a circuit board, a light condenser as well as a cover board; wherein one surface of the seat body includes a positioning space, and each of the two lateral sides of the seat body has an abutment surface on which a slot is installed; wherein the circuit board includes a circuit device and at least two conductive boards, the circuit device comprises a light emitting diode (LED) which is electrically connected to two conductive boards, and the circuit board is accommodated and positioned within the positioning space in the seat body such that the two conductive boards are located in the slot of the seat body and close to the abutment surface; wherein the light condenser has a lid and a hollow column extending from the end plane of the lid, with the lid covering the LED; wherein the cover board includes a positioning part, a through-hole penetrating through the cover board is configured on the positioning part, and the hollow column of the light condenser is placed in penetration within the through-hole with the front end of the light guiding line going into the hollow column thereby holding the light guiding line in fixation; additionally, the cover board is fixedly locked with the seat body by means of multiple lock-up component so as to fix the circuit board into the seat body in closure, while the LED corresponds to the through-hole such that the light generated by the LED can be projected into the hollow column via the lid of the light condenser in order to receive the generated light and transfer it to the end of the electric power cord by means of the light guiding line thus making the electric power cord glow; and wherein the set of conductive slices comprises a neutral wire conductive slice and a live wire conductive slice, and the neutral wire conductive slice and the live wire conductive slice are tightly inserted into the slot of the seat body fixedly in position such that the neutral wire conductive slice and the live wire conductive slice are directly jointed to the two conductive boards respectively thereby conducting electric power directly to the two conductive boards.

In a preferred embodiment, the light guiding line is made of a light fiber line material.

In a preferred embodiment, a recess part is configured on the abutment surface of the seat body close to the surface of the positioning space, and a notch is configured on the end part on a common wall of the recess part and the positioning space; meanwhile, the two conductive boards of the circuit board have a blocking board, a joint plate extends in bend from the blocking board such that the circuit board can be accommodated in position inside the positioning space of the seat body so the blocking board of the two conductive boards is located within the notch of the seat body and the extension plate is positioned within the recess part; when the blocking board is stopped and held by the notch, the circuit board can not move forwards and positioned within the positioning space of the seat body, thereby allowing the joint plate to be jointed in contact with the neutral wire conductive slice and the live wire conductive slice.

In a preferred embodiment, the cross-sectioned view of the conductive board is L-shaped, and a flange is configured on the joint plate.

In a preferred embodiment, the tail ends of both the neutral wire conductive slice and the live wire conductive slice are respectively configured with a terminal whose width is greater than the neutral wire conductive slice and the live wire conductive slice such that the terminal can be stopped by the blocking board of the conductive board and can not move forwards thereby allowing the terminal to joint to the blocking board.

In a preferred embodiment, a positioning hole is configured on the seat body and used to allow a ground wire conductive pillar to penetrate there through for connection.

In a preferred embodiment, the output ends of the power lines are connected to a power supply device or an appliance device such that AC power can be conducted into the circuit board and, at the same time, also transferred to the power supply device or the appliance device by way of the power lines.

DETAILED DESCRIPTION OF THE PREFERRED EMBODIMENTS

Other technical contents, aspects and effects in relation to the present invention can be clearly appreciated through the detailed descriptions concerning the preferred embodiments of the present invention in conjunction with the appended drawings.

Figure 1A:
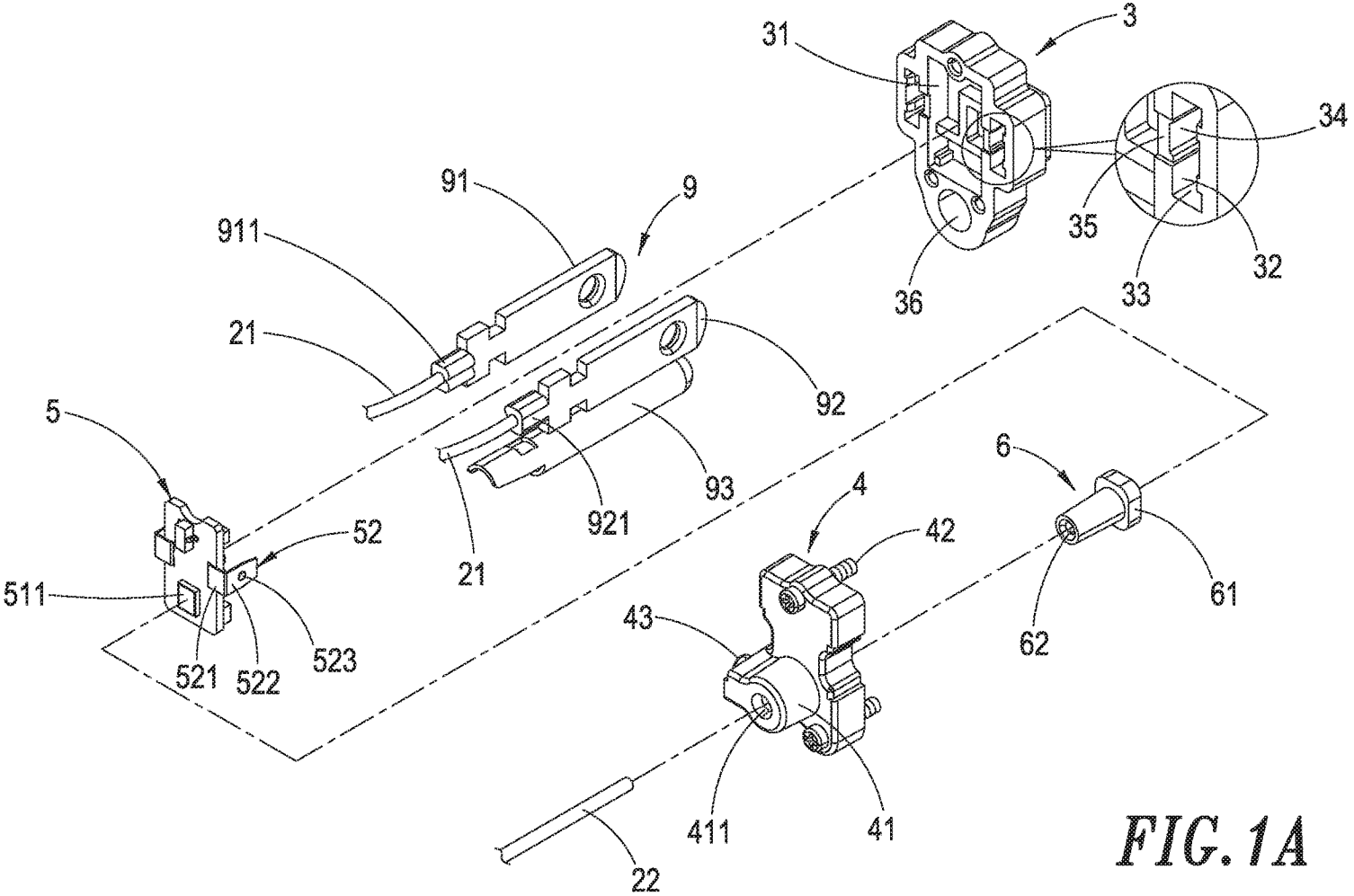
FIG. 1A shows a partial stereo structural disassembly view of the power plug structure for light emitting electric power cord according to the present invention.
Figure 1B:
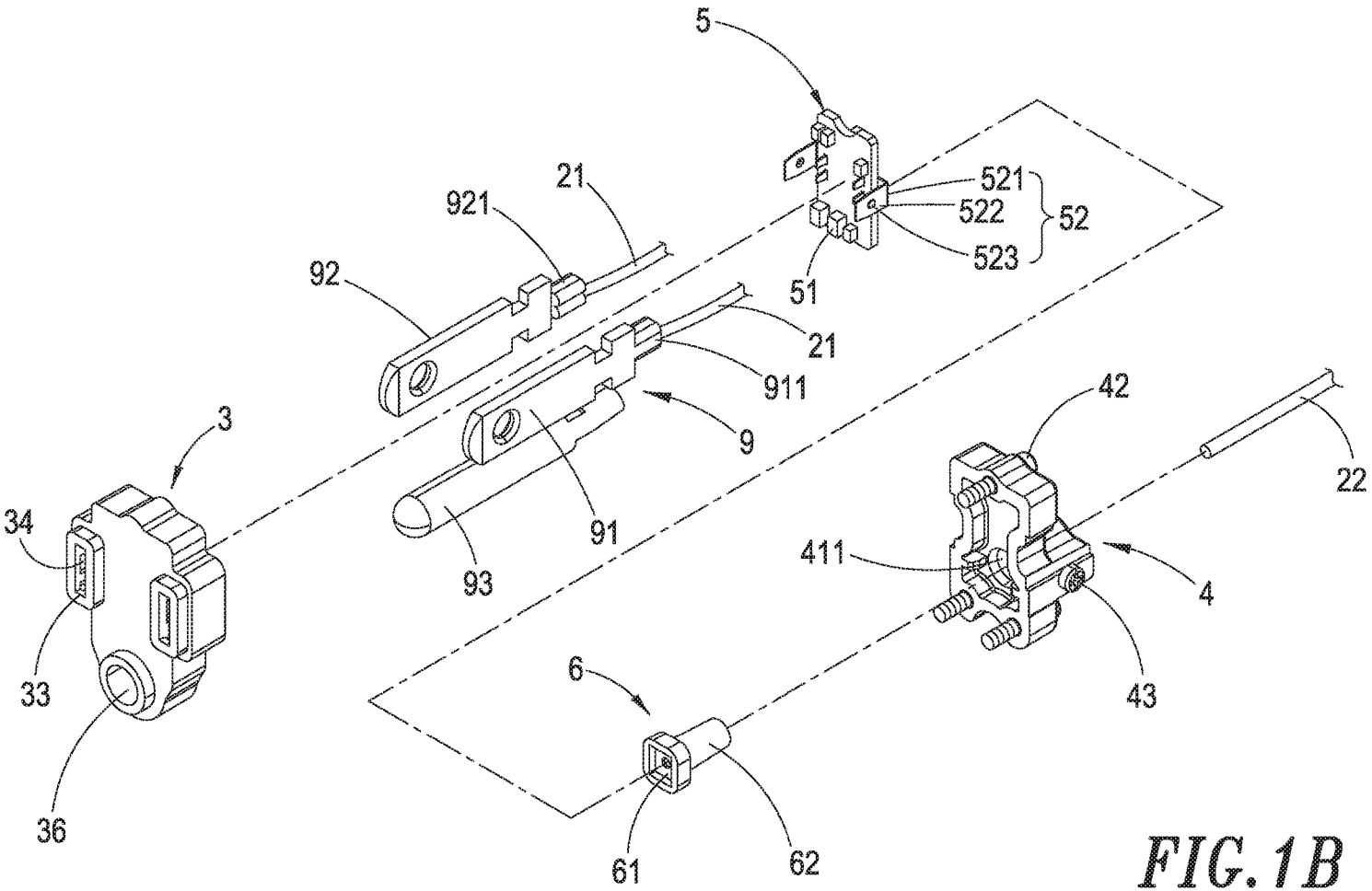
FIG. 1B shows a partial stereo structural disassembly view at another angle of the power plug structure for light emitting electric power cord according to the present invention.
Figure 1C:
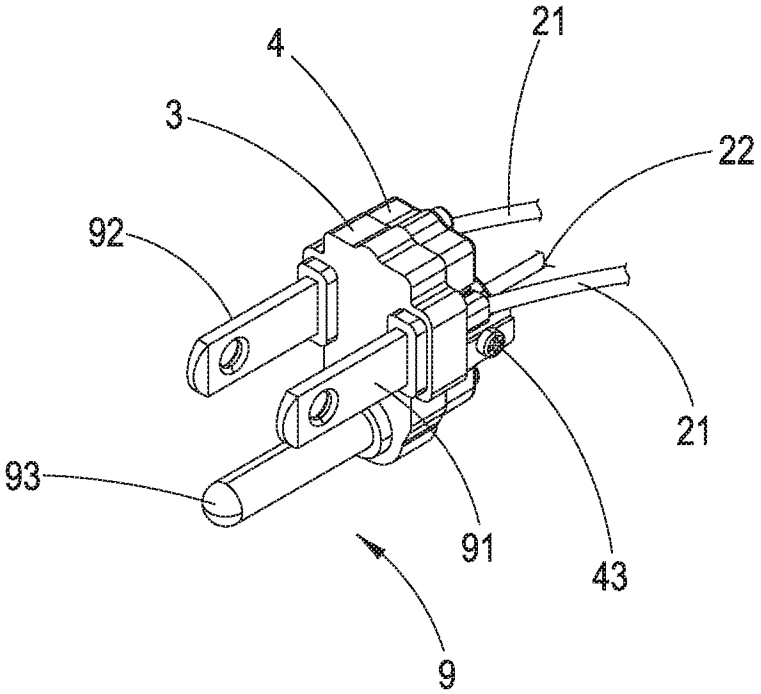
FIG. 1C shows a partial assembly view of the power plug structure for light emitting electric power cord according to the present invention.
Figure 1D:
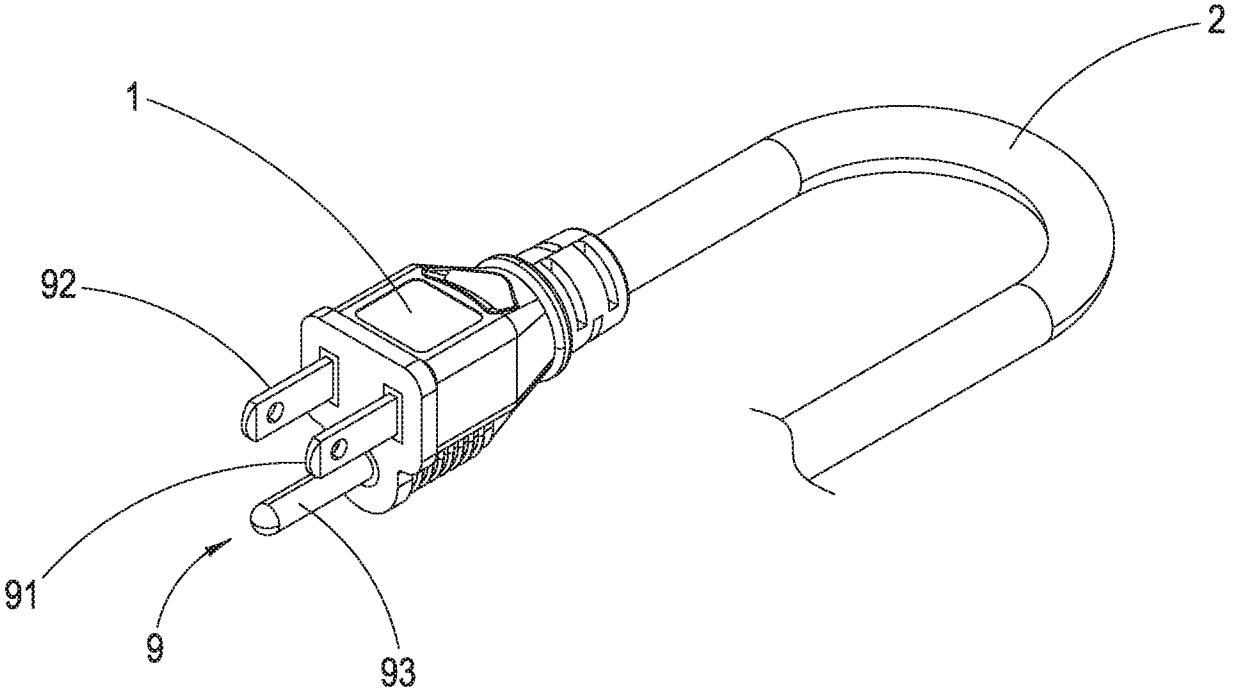
FIG. 1D shows a stereo structural assembly view of the power plug structure for light emitting electric power cord according to the present invention.
Figure 1E:
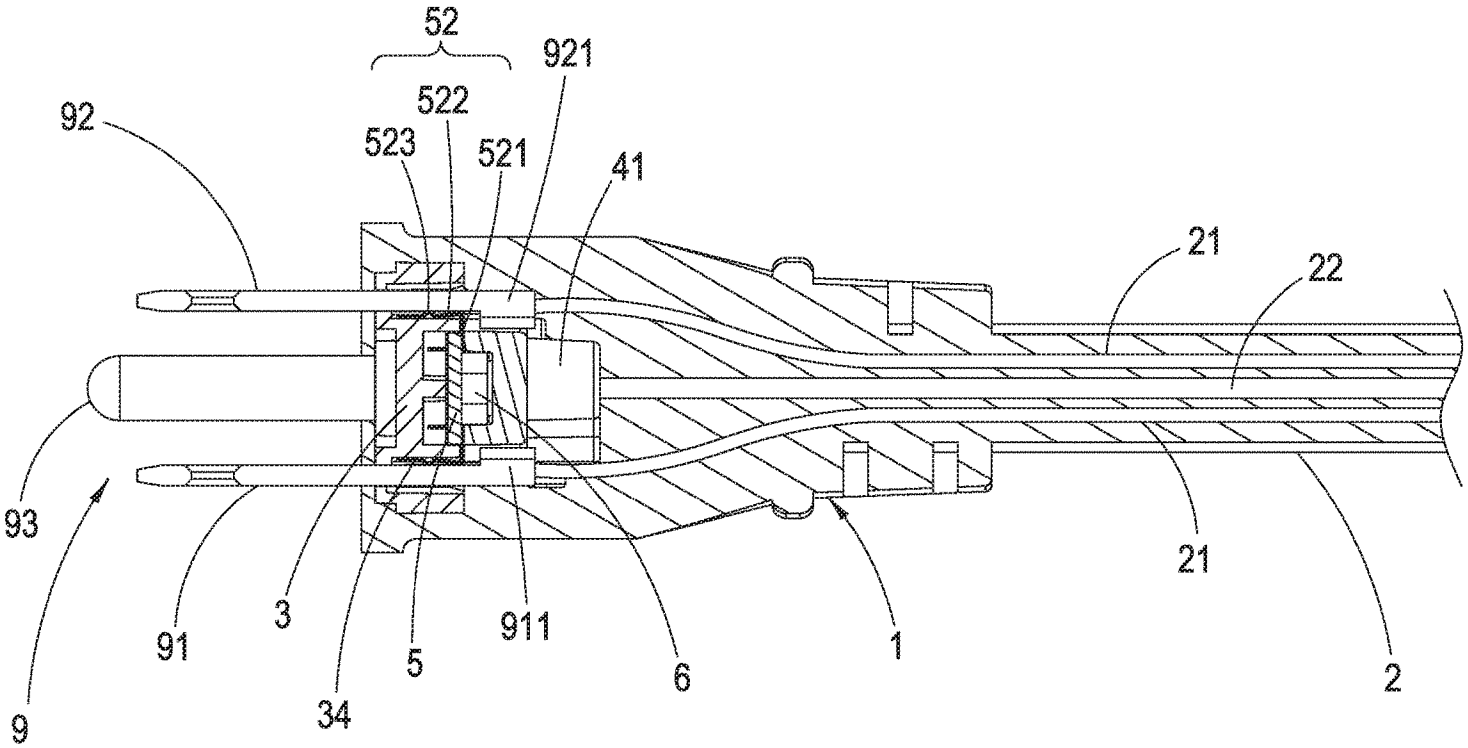
FIG. 1E shows a cross-sectioned structural view of the power plug structure for light emitting electric power cord according to the present invention.

Refer initially to FIGS. 1A-1E, wherein a power plug structure for light emitting electric power cord according to the present invention have been shown. First of all, as illustrated in FIGS. 1D and 1E, it mainly comprises a plug body 1 which is electrically connected to an electric power cord 2, and the plug body 1 is internally combined with a seat body 3, a cover board 4, a circuit board 5 and a light condenser 6, while the other end of plug body 1 opposite to the connection to the electric power cord 2 is installed in protrusion with a set of conductive slices 9.

The electric power cord 2 has a layer of translucent cladding, and also internally include multiple power lines 21 for transferring alternative current (AC) and at least a light guiding line 22 made of light fiber materials, in which the front ends of the power lines 21 and the light guiding line 22 all extend into the plug body 1.

Next, refer to FIGS. 1A-1C, wherein one surface of the seat body 3 has a positioning space 31, each of the two lateral sides on the seat body 3 has an abutment surface 32, a slot 33 is configured on the abutment surface 32 and a recess part 34 is configured on the abutment surface 32 close to the surface of the positioning space 31, in which the recess part 34 is located inside the slot 33, and a notch 35 is set up on the end part of a common wall of the recess part 34 and the positioning space 31.

Herein the circuit board 5 includes a circuit device 51 and at least two conductive boards 52, the circuit device 51 includes at least a light emitting diode (LED) 511 electrically connected to the two conductive boards 52 so that AC power can be directly conducted to the LED 511 by way of such two conductive boards 52 thereby allowing the LED 511 to general light; the cross-sectioned profile of the two conductive boards 52 are L-shaped and has a blocking board 521, a joint plate 522 extends in bend from the blocking board 521, and a flange 523 protrudes from the external surface of the joint plate 522, such that the circuit board 5 can be accommodated in position inside the positioning space 31 of the seat body 3 so the blocking board 521 of the two conductive boards 52 is located within the notch 35 of the seat body 3 and the extension plate 522 is positioned within the recess part 34 in the slot 33; in this way, when the blocking board 521 is accommodated within and stopped by the notch 35, the circuit board 5 may not move forwards and thus located inside the positioning space 31 of the seat body 3.

In addition, the light condenser 6 has a lid 61 and a hollow column 62 extending from the end plane of the lid 61, with the lid covering the LED 511, such that the light generated by the LED 511 can be spotlighted and projected into the hollow column 62.

Also, the cover board 4 includes a positioning part 41, a through-hole 411 penetrating through the cover board 4 is configured on the positioning part 41, and the hollow column 62 of the light condenser 6 is placed in penetration within the through-hole 411 with the front end of the light guiding line 22 going into the hollow column 62 thereby holding the light guiding line 22 in fixation and capable of receiving the light projected by the LED 511; additionally, the cover board 4 is fixedly locked with the seat body 3 by means of multiple lock-up component 42 so as to fix the circuit board 5 into the seat body 3 in closure.

Furthermore, the lateral side of the cover board 4 may be installed with a positioning element 43 which may be a screw and penetrate into the through-hole 411 so that the hollow column 62 of the light condenser 6 can be coercively and tightly pushed into the through-hole 411 by the positioning element 43.

Herein the set of conductive slices 9 includes at least a neutral wire conductive slice 91 and a live wire conductive slice 92, and the tail ends of the neutral wire conductive slice 91 and the live wire conductive slice 92 are respectively installed with a terminator 911, 921 whose widths are greater than the neutral wire conductive slice 91 and the live wire conductive slice 92. It can be seen that the neutral wire conductive slice 91 and the live wire conductive slice 92 are tightly inserted in position into the slot 33 of the seat body 3 so that the respective terminal 911, 921 at the tail ends of the neutral wire conductive slice 91 and the live wire conductive slice 92, and the terminal 911, 921 at the tail ends of the neutral wire conductive slice 91 and the live wire conductive slice 92 will be stopped by the blocking board 521 on the conductive board 52 and unable to move forwards thereby allowing the terminal 911, 921 to joint in contact with the blocking board 521 on the two conductive board 52 of the circuit board 4, and, by means of the flange 523, further ensuring the close attachment between the joint plates 522 of the two conductive boards 52 and the neutral wire conductive slice 91 and the live wire conductive slice 92 in order to guide AC power to the two conductive boards 522. Moreover, the depth of the recess part 34 is greater than the thickness of the joint plates 522 such that, when the joint plates 522 are pushed and squeezed by the neutral wire conductive slice 91 and the live wire conductive slice 92, it can move forward a distance towards the wall surface of the recess part 34 to generate an elastic force thus ensuring the tight contact between the joint plates 522 and the neutral wire conductive slice 91 and the live wire conductive slice 92.

Besides, it is also possible to additionally set up a positioning hole 36 on the seat body 3 based on demands thereby allowing a ground wire conductive pillar 93 to penetrate through it for connection.

Herein the seat body 3 internally combined with the set of conductive slices 6, the circuit board 5, the light condenser 6 and the cover board 4 is accommodated in position into the plug body 1 such that the power lines 21 can be electrically connected to the respective terminals at the tail ends of the neutral wire conductive slice 91 and the live wire conductive slice 92 so as to guide AC power to the output ends of the electric power cord 2, while the neutral wire conductive slice 91, the live wire conductive slice 92 and ground wire conductive pillar 93 are exposed outside the plug body 1.

Figure 2A:
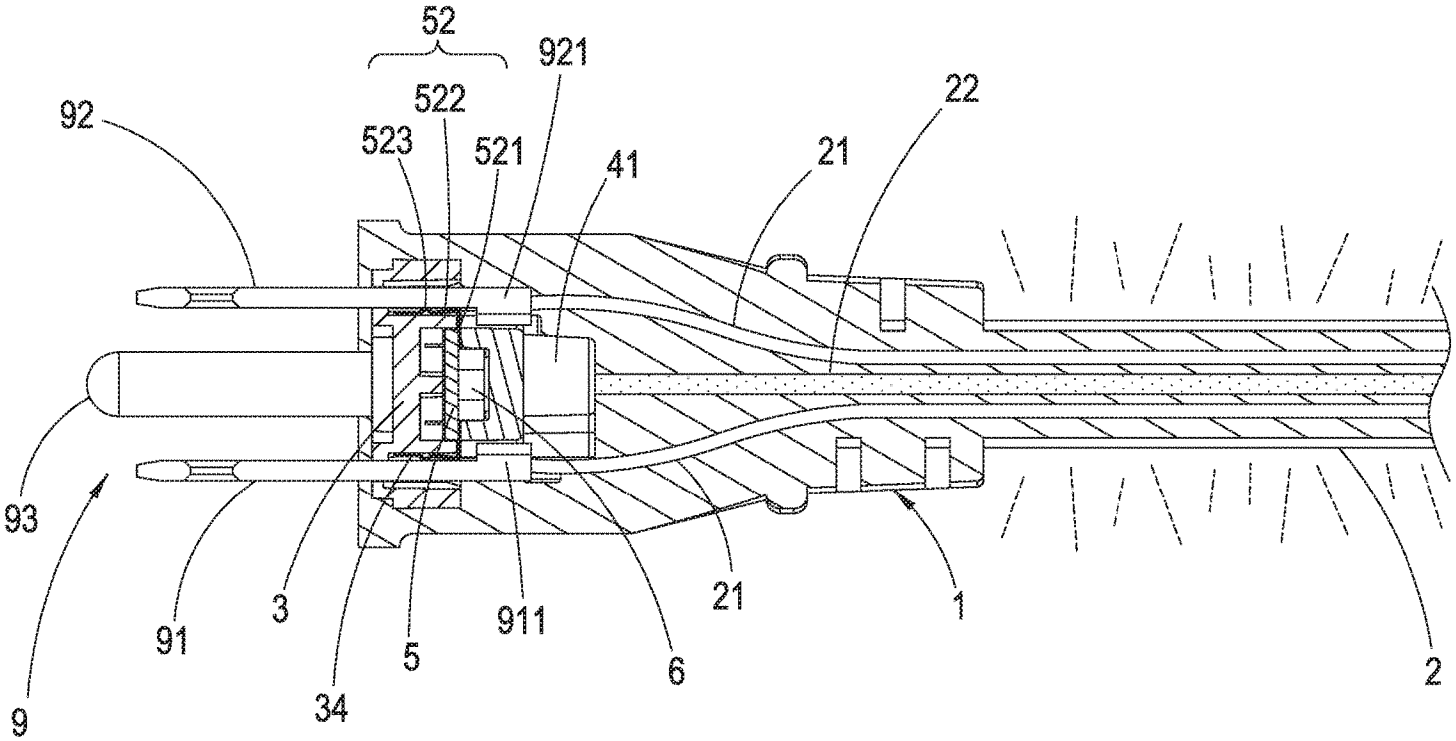
FIG. 2A shows a cross-sectioned structural view in an embodiment of the power plug structure for light emitting electric power cord according to the present invention.
Figure 2B:
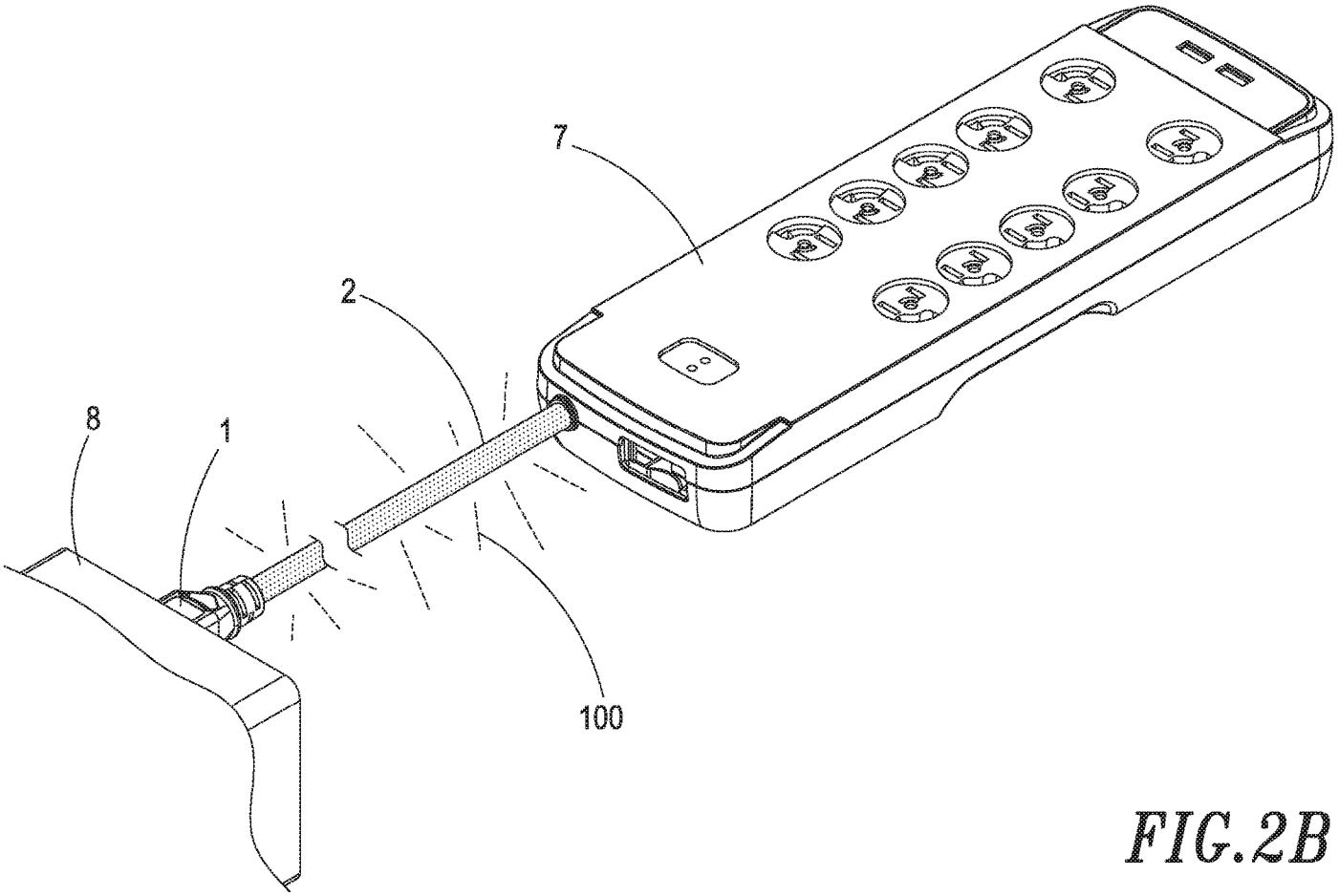
FIG. 2B shows an application view in an embodiment of the power plug structure for light emitting electric power cord according to the present invention.

Meanwhile, as shown in FIGS. 2A and 2B, the other end of the electric power cord 2 is connected with an electric device or power supply device 7 (as shown in Figures, the power supply device 7 may be an extension cord socket.) After inserting the set of conductive slices 9 into a power socket 8, AC power is directly guided into the circuit device 51 via the two conductive boards 52 so that the circuit device 51 can drive the LED 511 to generate light 100 which will be converged and projected towards the inside of the hollow column 62 by means of the lid 61 on the light condenser 6 in order to let the light guiding line 22 receive and transfer the light 100 thereby making the entire light guiding line 22 fully distributed with light, and then the light 100 travels out of the electric power cord 2 so the entire electric power cord 2 glows. In addition to being guided into the circuit board 4, above-said AC power can be also transferred to the electric device or the power supply device 7 at the same time thus that the electric device or the power supply device 7 can operate normally.

Figure 3:
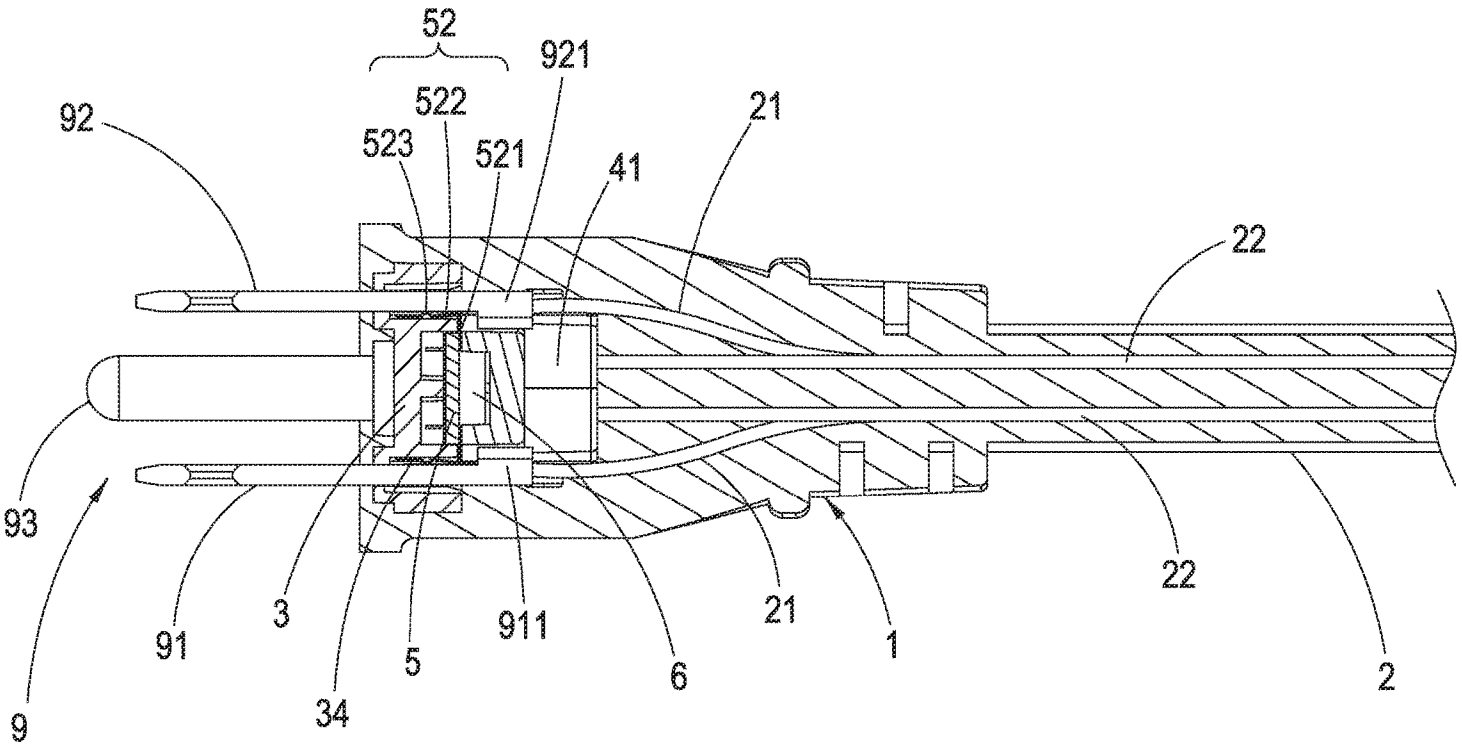
FIG. 3 shows a cross-sectioned structural view in another embodiment of the power plug structure for light emitting electric power cord according to the present invention.

Furthermore, as shown in FIG. 3, the inside of the positioning part 41 in the cover board 4 has two through-holes 411 penetrating the cover board 4 thereby allowing the two hollow columns 62 respectively penetrate in position, further jointing the two light guiding lines 22 to let them go through the hollow columns 62; two LEDs 511 may be installed on the circuit board 4 and individually covered by the lid 61 of the light condenser 6 such that the LED 51 may project light towards the hollow column 62 to increase or create different glowing effects. Certainly, more through-holes 411 may be set up on the lid 4, and a correspondingly increased number of LEDs 511 may be installed on the circuit board 5 as well, with each LED 511 being covering by a lid 61 of the light condenser 6 in order to make the light converge, but it should be appreciated that the present invention is by no means limited thereto.

In comparison with other conventional technologies, the power plug structure for light emitting electric power cord according to the present invention provides the following advantages:

(1) the present invention uses LED as the light sources so as to be able to simplify the circuit design for AC-to-DC conversions, thus minimizing the circuit and, accordingly, obtaining a relatively smaller integral circuit board, which facilitates convenient assemblage within the electric power plug without having to modify the size and profile of the electric power plug;

(2) in the present invention, the circuit board and the light guiding line are installed within a conventional electric power cord, so it needs not to greatly alter the structure of the electric power cord to allow the electric power cord to have the intended electric conductivity and illumination effects;

(3) the present invention directly attaches the two conductive boards to the conductive slices for power transfer in order to reduce the wiring time thereby providing cost-saving and fast assemblage effects.

It should be noticed that, although the present invention has been disclosed through the detailed descriptions of the aforementioned embodiments, such illustrations are by no means used to restrict the scope of the present invention; that is, skilled ones in relevant fields of the present invention can certainly devise any applicable alternations and modifications after having comprehended the aforementioned technical characteristics and embodiments of the present invention without departing from the spirit and scope thereof. Hence, the scope of the present invention to be protected under patent laws should be delineated in accordance with the claims set forth hereunder in the present specification.

What is claimed is:

1. A power plug structure for light emitting electric power cord, comprising:

a plug body, with one end thereof being connected to an electric power cord having a translucent cladding, wherein the inside of the electric power cord includes multiple power lines for transferring alternative current (AC) and at least a light guiding line, the front ends of such power lines and the light guiding line respectively extend into the plug body, while the other end of the plug body not installed with the electric power cord is configured in exposure with a set of conductive slices such that the power lines can be electrically connected to the set of conductive slices respectively, thereby conducting electric power to the output ends of the power lines, and the plug body is also installed in combination with a seat body, a circuit board, a light condenser as well as a cover board;

wherein one surface of the seat body includes a positioning space, and each of the two lateral sides of the seat body has an abutment surface on which a slot is installed;

wherein the circuit board includes a circuit device and at least two conductive boards, the circuit device comprises a light emitting diode (LED) which is electrically connected to the at least two conductive boards, and the circuit board is accommodated and positioned within the positioning space in the seat body such that the two conductive boards are located in the slot of the seat body and close to the abutment surface;

wherein the light condenser has a lid and a hollow column extending from the end plane of the lid, with the lid covering the LED;

wherein the cover board includes a positioning part, a through-hole penetrating through the cover board is configured on the positioning part, and the hollow column of the light condenser is placed in penetration within the through-hole with the front end of the light guiding line going into the hollow column thereby holding the light guiding line in fixation; additionally, the cover board is fixedly locked with the seat body by means of multiple lock-up component so as to fix the circuit board into the seat body in closure, while the LED corresponds to the through-hole such that the light generated by the LED can be projected into the hollow column via the lid of the light condenser in order to receive the generated light and transfer it to the end of the electric power cord by means of the light guiding line thus making the electric power cord glow;

wherein the set of conductive slices comprises a neutral wire conductive slice and a live wire conductive slice, and the neutral wire conductive slice and the live wire conductive slice are tightly inserted into the slot of the seat body fixedly in position such that the neutral wire conductive slice and the live wire conductive slice are directly jointed to the two conductive boards respectively thereby conducting electric power directly to the two conductive boards.

2. The power plug structure for light emitting electric power cord according to claim 1, in which the light guiding line is of a light fiber line material.

3. The power plug structure for light emitting electric power cord according to claim 1, in which a recess part is configured on the abutment surface of the seat body close to the surface of the positioning space, and a notch is configured on the end part on a common wall of the recess part and the positioning space; meanwhile, the two conductive boards of the circuit board have a blocking board, a joint plate extends in bend from the blocking board such that the circuit board can be accommodated in position inside the positioning space of the seat body so the blocking board of the two conductive boards is located within the notch of the seat body and the extension plate is positioned within the recess part; when the blocking board is stopped and held by the notch, the circuit board can not move forwards and positioned within the positioning space of the seat body, thereby allowing the joint plate to be jointed in contact with the neutral wire conductive slice and the live wire conductive slice.

4. The power plug structure for light emitting electric power cord according to claim 3, in which the cross-sectioned view of the conductive board is L-shaped, and a flange is configured on the joint plate.

5. The power plug structure for light emitting electric power cord according to claim 4, in which the tail ends of both the neutral wire conductive slice and the live wire conductive slice are respectively configured with a terminal whose width is greater than the neutral wire conductive slice and the live wire conductive slice such that the terminal can be stopped by the blocking board of the conductive board and can not move forwards thereby allowing the terminal to joint to the blocking board.

6. The power plug structure for light emitting electric power cord according to claim 1, in which a positioning hole is configured on the seat body and used to allow a ground wire conductive pillar to penetrate for connection.

7. The power plug structure for light emitting electric power cord according to claim 1, in which the output ends of the power lines are connected to a power supply device or an appliance device such that AC power can be conducted into the circuit board and, at the same time, also transferred to the power supply device or the appliance device by way of the power lines.

* * * * *